US005485251A

United States Patent [19]

Kita et al.

[11] Patent Number: 5,485,251

[45] Date of Patent: Jan. 16, 1996

[54] CLEANING DEVICE FOR AN ELECTROSTATIC CHARGER

[75] Inventors: Hideki Kita; Akira Nakamura; Yasuyuki Fukunaga; Toshinobu Katafuchi, all of Osaka, Japan

[73] Assignee: Mita Industrial Co., Ltd., Osaka, Japan

[21] Appl. No.: 299,756

[22] Filed: Sep. 1, 1994

[30] Foreign Application Priority Data

Sep. 6, 1993 [JP] Japan ..... 5-220884

[51] Int. Cl.[6] ..... G03G 21/00

[52] U.S. Cl. ..... 355/215; 355/221; 355/225

[58] Field of Search ..... 355/215, 219, 355/221, 225; 250/324, 325; 361/225, 229

[56] References Cited

U.S. PATENT DOCUMENTS

| | | | |
|---|---|---|---|
| 3,842,273 | 10/1974 | Van Buskirk | 250/324 |
| 3,875,407 | 4/1975 | Hayne | 250/324 |
| 4,956,671 | 9/1990 | Otsuka | 355/215 |
| 5,023,748 | 6/1991 | Okamoto et al. | 361/229 |
| 5,170,314 | 12/1992 | Saito | 361/225 X |

FOREIGN PATENT DOCUMENTS

| | | |
|---|---|---|
| 61-124969 | 6/1986 | Japan . |
| 61-117579 | 6/1986 | Japan . |
| 2-105179 | 4/1990 | Japan . |
| 4-000463 | 1/1992 | Japan . |
| 4-146463 | 5/1992 | Japan . |

*Primary Examiner*—Robert Beatty
*Attorney, Agent, or Firm*—Koda and Androlia

[57] ABSTRACT

A cleaning device for a SCOROTRON type electrostatic charger to be used in an image forming apparatus such as a copying machine wherein both discharge wire and grid wire are cleaned by reciprocating a first cleaning member which is contactable with the discharge wire of the electrostatic charger and a second cleaning member contactable with the grid wire. Also, the respective cleaning members are alternately brought into contact with the respective discharge and grid wires in the forward stroke and return stroke of the first and second cleaning members.

2 Claims, 5 Drawing Sheets

10
12
13
9
2
17
3
5a
5
4
18
6
14
15

CLEANING DEVICE FOR AN ELECTROSTATIC CHARGER

BACKGROUND OF THE INVENTION

1. Field of the invention

The present invention relates to a cleaning device for a Scorotron type electrostatic charger which is used in an image forming apparatus such as a copying machine.

2. Description of the Prior Art

A Scorotron type electrostatic charger of an image forming apparatus such as a copying machine is such that grid wires are provided between a photosensitive body and a corona discharge wire and a fixed potential is given to the photosensitive body with high voltage applied by the corona discharge wire. Both the wires on the electrostatic charger may get soiled due to splashed toner and pieces of paper while copying is continued in such a copying machine. The soiling may cause the surface potential of the photosensitive body to fluctuate and in line therewith the image density may change. For this reason, a cleaning device for an electrostatic charger was developed (Japanese Patent Publication NO. Sho-63-24561).

Figure 5:
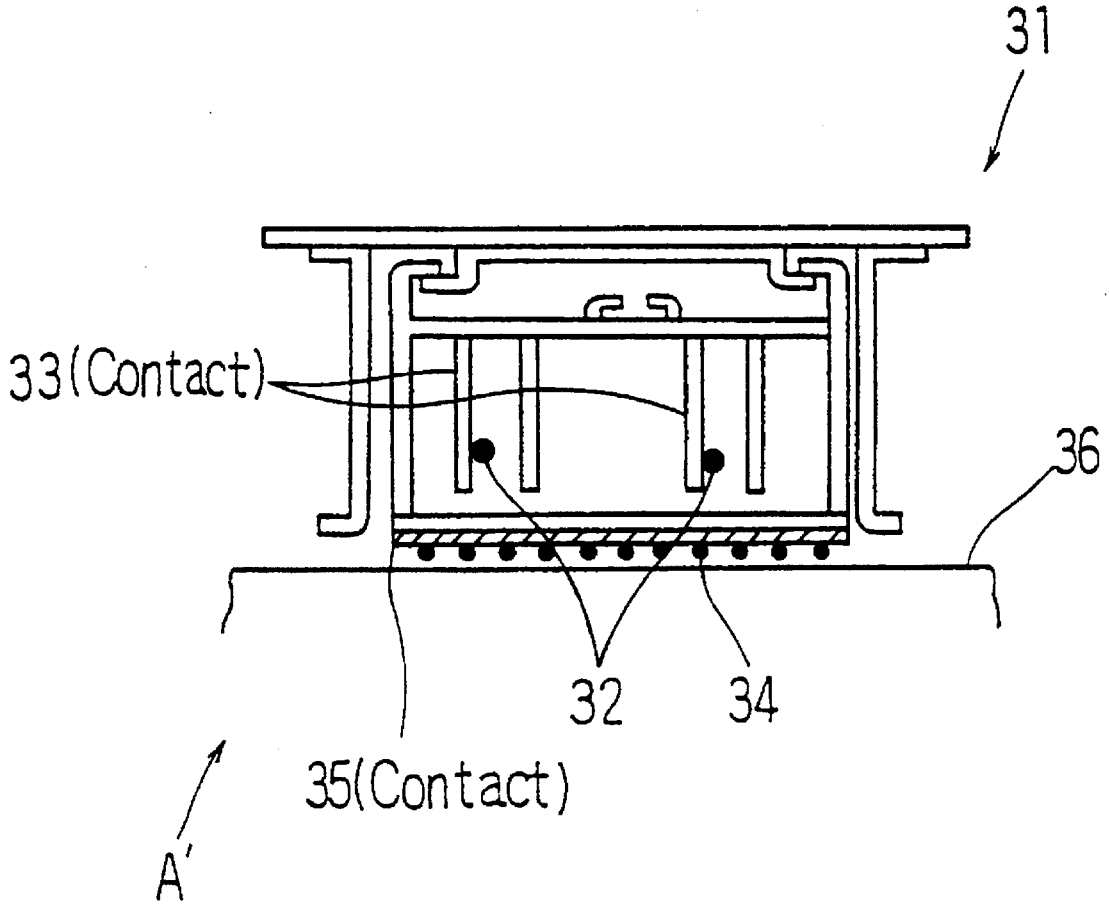
Fig. 5 PRIOR ART

FIG. 5 is a simulative diagram showing the outline configuration in an example of cleaning devices A' for the conventional electrostatic chargers.

As shown in FIG. 5, a cleaning device A' for a conventional electrostatic charger 31, in which a wire cleaning member 33 for cleaning discharge wires 32 and a grid cleaning member 35 for cleaning grid wires 34 are provided, is of such a structure that both the members 33 and 35 are integrated together. And it is composed so that the discharge wires 32 and grid wires 34 are simultaneously cleaned by reciprocating both the members 33 and 35 simultaneously in the extending direction of the discharge wires 32 and grid wires 34 by a drive unit (not illustrated). And in FIG. 5, 36 indicates the photosensitive body.

As with a cleaning device A' for the conventional electrostatic charger 31 the discharge wires 32 and grid wires 34 are simultaneously cleaned, the drive load of the cleaning members was remarkably heavy, thereby resulting in an increase of the production cost of an apparatus and an increase of the consumption power thereof.

SUMMARY OF THE INVENTION

In order to solve the above problems in the conventional technology, the invention was developed. It is therefore an object of the invention to provide a cleaning device for an electrostatic charger, which is of simple structure and needs less consumption power.

In order to achieve the object, a cleaning device according to the invention comprises a first cleaning member which is contactable with the discharge wire of an electrostatic charger and a second cleaning member which is contactable with the grid wires and is characterized in that in a cleaning device for an electrostatic charger, which cleans both the wires by reciprocating the first and second cleaning members, the respective cleaning members are alternately contactable with each of the wires in the forward stroke and return stroke. The first and second cleaning members may be in a non-contact state for the respective wires in the standby state thereof.

According to the invention, while both the wires are being cleaned, the respective cleaning members are alternately contactable with each of the wires in the forward stroke and return stroke of the movements of the first and second cleaning members by reciprocating the first cleaning member contactable with the discharge wire of the electrostatic charger and the second cleaning member contactable with the grid wires.

Therefore, the drive load of the cleaning members can be lightened. Furthermore, in a case where the first and second cleaning members are in a non-contact state in their standby state, the entire load of the cleaning members relative to both the wires comes to zero. As a result, it is possible to obtain a cleaning device for an electrostatic charger which is of a simple structure and needs less consumption power.

The specifications point out the main theme of the invention and end with the claims which are clearly claimed for a patent. The invention will be easily understandable with the following description with reference to the drawings attached herewith.

A BRIEF DESCRIPTION OF THE DRAWINGS

Figures 1A, 1B, 1C:
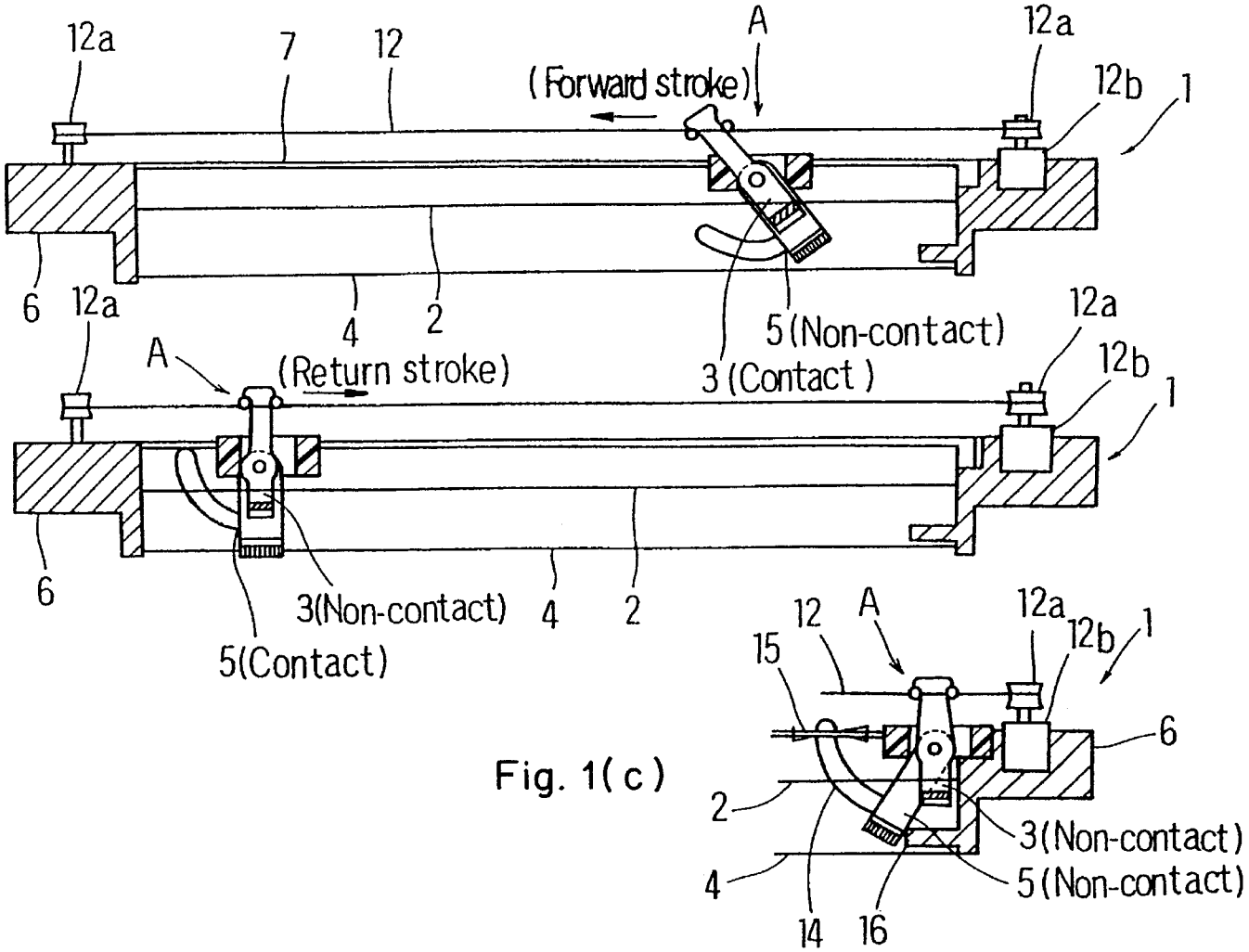
Figure 2:
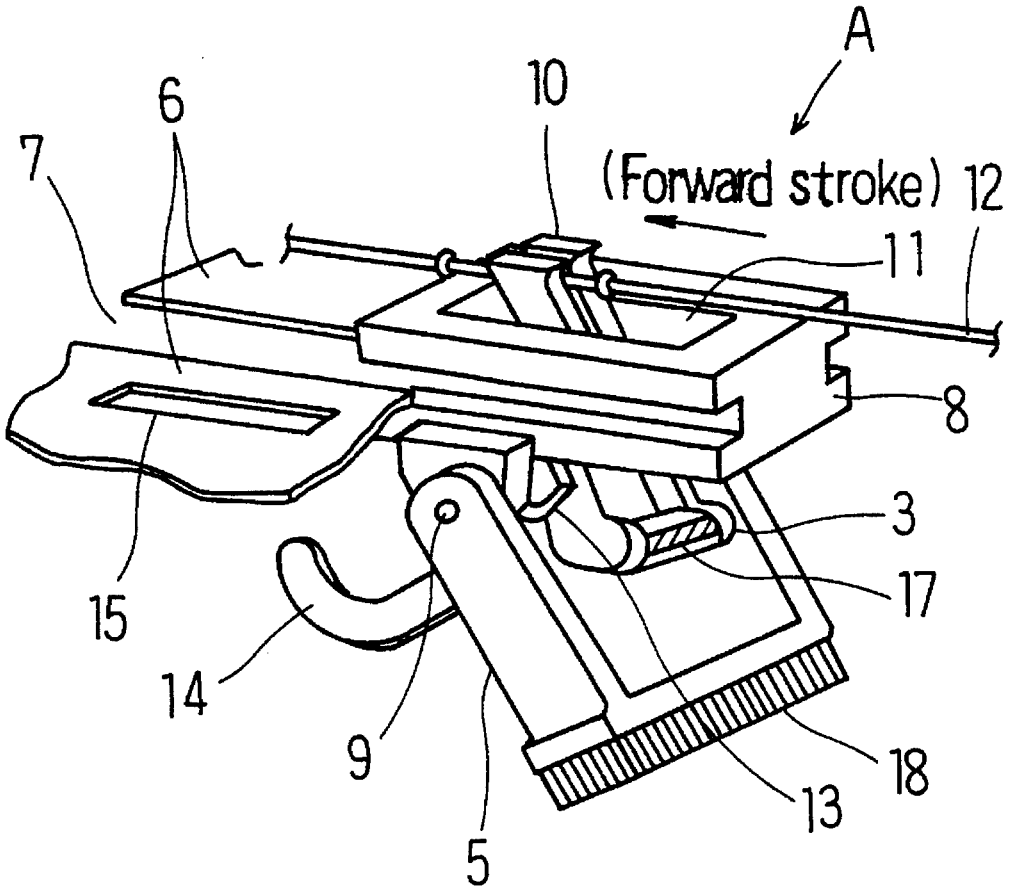
Figure 3:
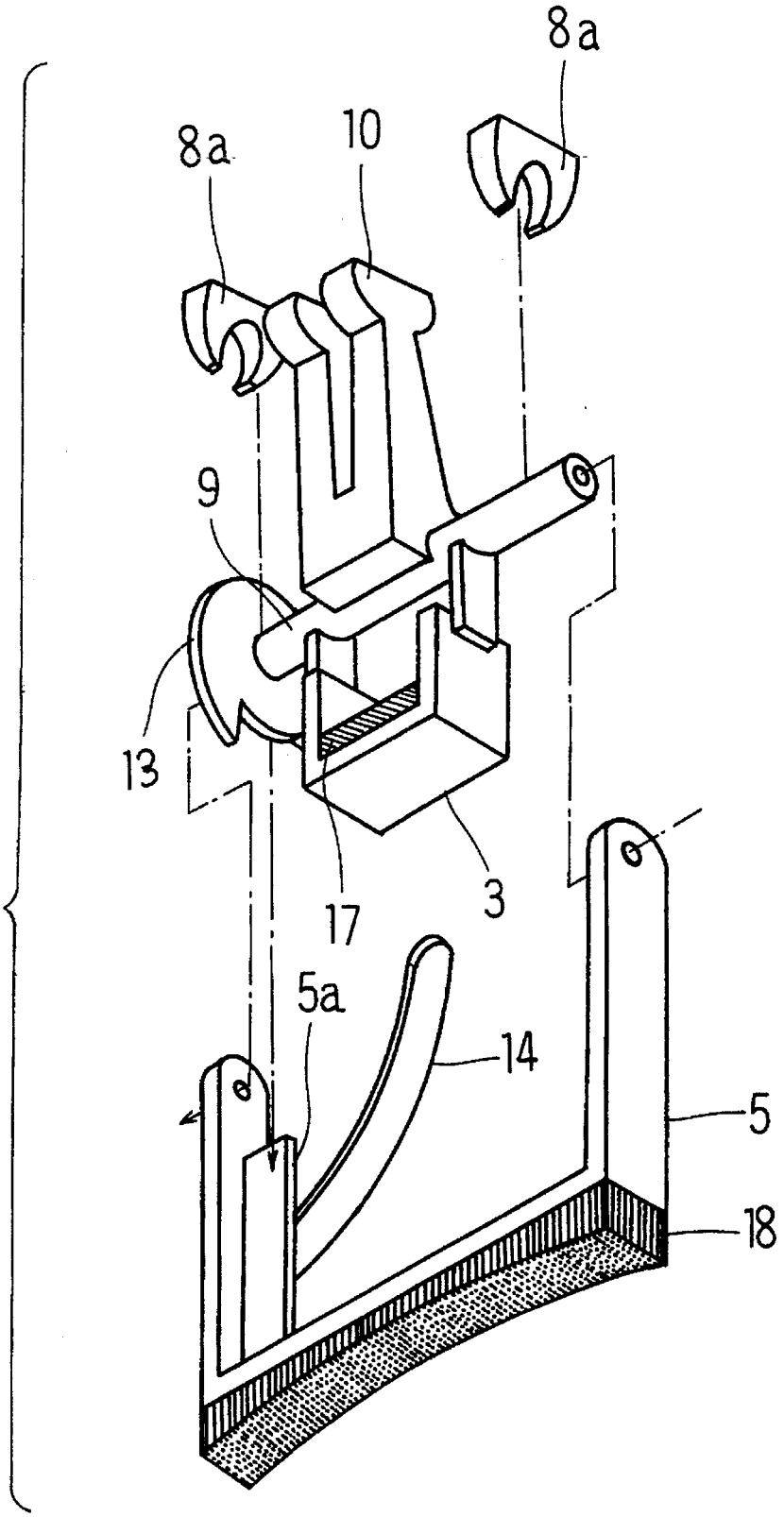
Figures 4A, 4B, 4C:
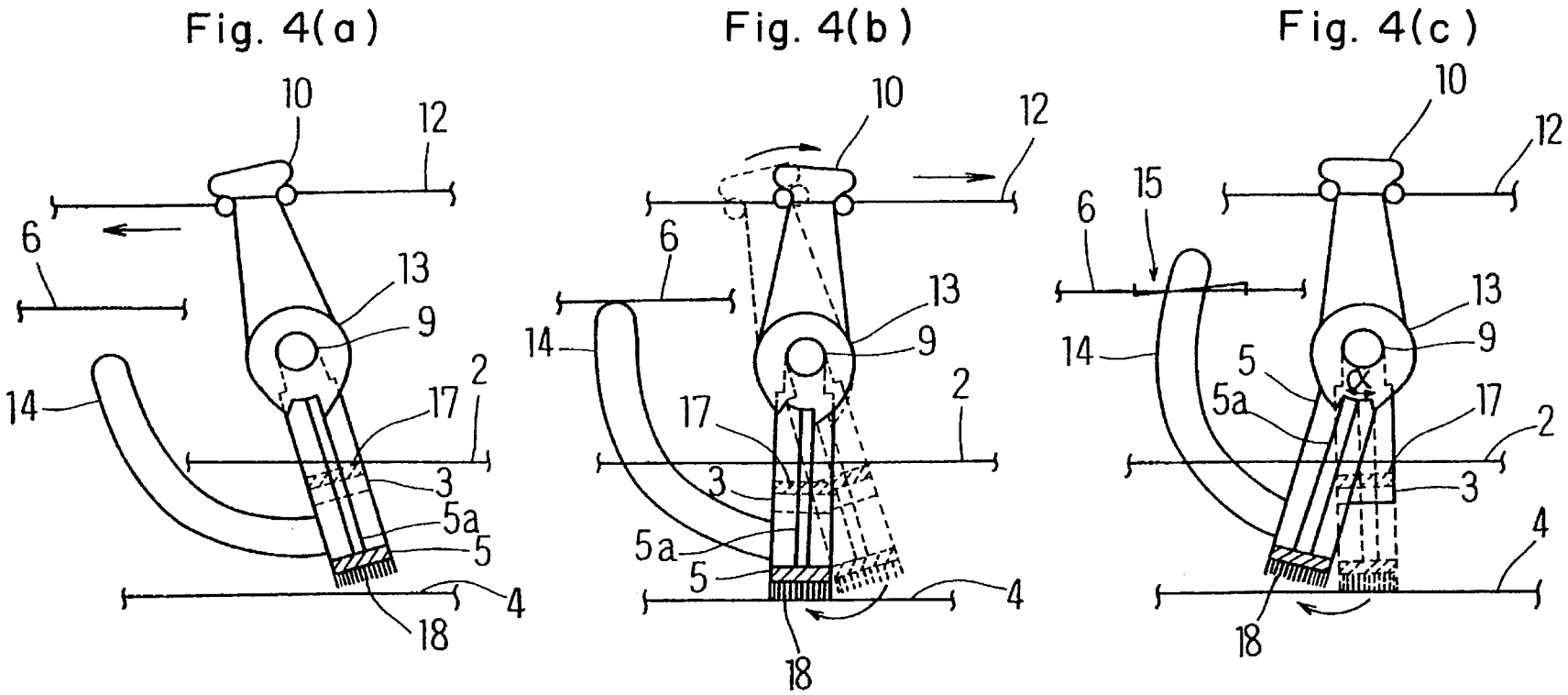

FIGS. 1A, 1B and 1C are simulative views showing the outline configuration and actions of a cleaning device A for an electrostatic charger according to a preferred embodiment of the invention, FIG. 2 is a perspective view showing a state where the above device A is on the return stroke, FIG. 3 is a disassembled perspective view of the above device A, FIGS. 4A, 4B and 4C are detailed views for explaining the actions of the above device A, and FIG. 5 is a simulative view showing the outline configuration of an example of the cleaning device A' for a conventional electrostatic charger.

A DETAILED DESCRIPTION OF THE PREFERRED EMBODIMENT

While only certain embodiments of the present invention have been described, it will be apparent to those skilled in the art that various changes, variations and modifications may be made therein without departing from the spirit and scope of the present invention.

As shown in FIGS. 1(*a*) to (*c*), a cleaning device "A" for an electrostatic charger according to the present invention comprises a first cleaning member 3 which is contactable only with a discharge wire 2 of an electrostatic charger 1 and a second cleaning member 5 which is contactable only with grid wires 4, and is characterized in that, when cleaning both the wires, the first and second cleaning members 3 and 5 are alternately brought into contact with the respective wires 2 and 4 in the forward stroke and return stroke of each cleaning member by reciprocating the first and second cleaning members 3 and 5.

The invention will be described in further detail.

As shown in FIG. 2 and FIG. 3, the cleaning device "A" is provided with a supporting member 8 which is caused to slide while being guided by a laterally long groove 7 formed on the ceiling plane of the shield casing 6. A pin 9 is rotatably supported at the bracket portions 8*a* secured at the supporting member 8. The first cleaning member 3 is secured and fixed at the pin 9, and the second cleaning member 5 is pivotally fixed thereat relative to the first cleaning member 3. An engaging portion 10 formed at the upper end of the first cleaning member 3 is inserted into a through hole 11 vertically passing through the central portion of the supporting member 8, and the swinging of the first cleaning member 3 is regulated in the width of the through hole 11.

On the other hand, a reciprocating means which is driven by a motor is installed at the upper portion of the shield case 6. In the example illustrated, a rope 12, pulley 12*a* and motor 12*b* correspond to the reciprocating means. The engaging portion 10 of the first cleaning member 3 is engaged with the rope 12. Thereby, in line with the reciprocatory movements of the rope 12, the first cleaning member 3, the supporting member 8 linked integrally therewith and the second cleaning member 5 are guided and are caused to travel in the groove 7.

When the first cleaning member 3 is caused to rotate clockwise in FIG. 1, an interference piece 13 which is engaged with a projection 5*a* of the second cleaning member 5 is secured integrally at the first cleaning member 3. And when the second cleaning member 5 is caused to rotate clockwise in FIG. 1, a regulating piece 14 which is brought into contact with the lower surface of the ceiling of the shield case 6 and regulates the rotation of the second cleaning member 5 is provided integrally at the second cleaning member 5. Furthermore, the regulating piece 14 is put into a hole 15 formed at the ceiling plane of the shield case 6 when the cleaning device "A" comes to the right end in FIG. 1, whereby the rotation regulation of the second cleaning member 5 is cancelled. At this time, it is preferable that a fitting piece 16 of the second cleaning member 5, which is shown in FIG. 1(*c*), is provided at the right end of the shield case 6 so that the second cleaning member 5 is forcedly released from the grid wires 4.

In the drawings, 17 is brush attached to the first cleaning member 3, and 18 is a brush attached to the second cleaning member 5. The soiling of the respective wires can be eliminated by the respective brushes being alternately brought into contact with the discharge wire and grid wires.

The following description deals with the actions of the cleaning device "A" with reference to FIG. 1 and FIG. 4.

As the rope 12 is caused to travel in the left direction as shown in FIG. 1(*a*) (forward stroke), the first cleaning member 3 engaged with the rope 12 at the engaging portion 10 is caused to rotate counterclockwise, the brush 17 secured at the lower end is brought into contact with the discharge wire 2, thereby causing the soiling thereof to be eliminated. At this time, as no force to regulate the rotation of the second cleaning member 5 operates thereon, the projection 5*a* of the second cleaning member 5 is caused to move until it is brought into contact with the interference piece 13, and the brush 18 is such that it is not in contact with the grid wires 4. Namely, in the forward stroke, only the brush 17 is brought into contact with the discharge wire 2, thereby causing only the discharge wire 2 to be cleaned.

Next, as the rope 12 is reversed from the forward stroke to the return stroke and begins travelling in the right direction in FIG. 1, the first cleaning member 3 is caused to rotate clockwise while being pulled by the rope 12, as shown in FIG. 1(*b*). Consequently, the brush 17 of the first cleaning member 3 is separated from the discharge wire 2. When the first cleaning member 3 is caused to rotate clockwise as shown above, the interference piece 13 is rotated while contacting the second cleaning member 5, as shown in FIG. 4(*b*), thereby causing the second cleaning member 5 to be rotated clockwise. And at the moment when the second cleaning member 5 is rotated up to the upright state thereof as shown in FIG. 1(*b*), the regulating piece 14 is brought into contact with the lower surface of the ceiling of the shield case 6. Therefore, both the first and second cleaning members 3 and 5 enter their upright state as illustrated, and only the brush 18 of the second cleaning member 5 will be brought into contact with the grid wires 4.

In this state, when the cleaning device "A" is led to the right end of the shield case 6 as shown in FIG. 1(*c*) and FIG. 4(*c*), the regulating piece 14 is put and fitted in the hole 15, whereby the regulating force to keep the brush 18 of the second cleaning member 5 in contact with the grid wires 4 is cancelled, and a so-called standby state is made. This is because, as a slack equivalent to a degree of angle $\alpha$ is provided for the contact between the interference piece 13 and the projection 5*a* of the second cleaning member 5 as shown in FIG. 4(*c*), the second cleaning member 5 will be moved leftward in the drawing to such a degree as being equivalent to the slack. Therefore, all the load relative to both the wires 2 and 4 will come to zero in this standby state. If, at this time, the second cleaning member 5 is composed so that it is brought into contact with the engaging piece 16, both the brushes 17 and 18 are completely separated from both the wires 2 and 4, and there is no fear of generating a hindrance in the discharge function for the image forming operations, etc under this condition. Thereafter, where the rope 12 begins to travel in the left direction again, the interference piece 13 is rotated while contacting the projection 5*a* of the second cleaning member 5, and the second cleaning member 5 is caused to rotate counterclockwise (FIG. 4(*a*)).

As described above, according to the preferred embodiment, the drive load of the cleaning members can be much lightened, in comparison with a case where the discharge wire 2 and grid wires 4 are simultaneously cleaned. Furthermore, the drive force of the reciprocatory movement means is able to be utilized as an escape mechanism of the cleaning members from both the wires. No other separation or release mechanism is used. Still furthermore, as the first and second cleaning members 3, 5 are coaxially rotated and released, the mechanism itself is made simple. Thus, as the mechanism is made considerably simple, the device is almost free from any troubles and the production cost thereof can be decreased.

Still furthermore, in a case where the first and second cleaning members are separated from the respective wires in their standby state, all the load of the cleaning members relative to both the wires will come to zero.

As a result, it is possible to provide a cleaning device for an electrostatic charger, which is of simple structure and needs less consumption power.

Also, in the above preferred embodiment, the second cleaning member 5 is separated from the grid wires 4 while the discharge wire 2 is being cleaned on the forward stroke. Contrarily, the first cleaning member 3 is separated from the discharge wire 2 while the grid wires 4 are being cleaned on the return stroke. However, in actual applications, there is no problem if the objects to be cleaned may be reversed in the forward stroke and return stroke.

What is claimed is:

1. A cleaning device for an electrostatic charger comprising: a first cleaning member which contacts with and separates from a discharge wire of an electrostatic charger, tensed parallel with a photosensitive body, and a second cleaning member which contacts with and separates from a grid wire provided between the photosensitive body and the discharge wire and tensed parallel with the photosensitive body, and being characterized in that, in a cleaning device for an electrostatic charger, which cleans both the discharge and grid wires by reciprocating the first and second cleaning members together in a same direction, the respective first and second cleaning members alternately contacts with each of the discharge and grid wires in the forward stroke and return stroke.

2. A cleaning device for an electrostatic charger set forth in claim 1, wherein the first and second cleaning members are in a separated state from each of the discharge and grid wires while they are in a standby state.

* * * * *